US008852131B2

(12) United States Patent
Siegner

(10) Patent No.: US 8,852,131 B2
(45) Date of Patent: Oct. 7, 2014

(54) SUPPORT SURFACE SYSTEM PROVIDING SIMULTANEOUS ALTERNATING PRESSURE AND LOW AIR LOSS THERAPIES

(75) Inventor: Kenneth Scott Siegner, Calimesa, CA (US)

(73) Assignee: Anodyne Medical Device, Inc., Coral Springs, FL (US)

( * ) Notice: Subject to any disclaimer, the term of this patent is extended or adjusted under 35 U.S.C. 154(b) by 876 days.

(21) Appl. No.: 12/882,966

(22) Filed: Sep. 15, 2010

(65) Prior Publication Data

US 2012/0065560 A1 Mar. 15, 2012

(51) Int. Cl.

| | |
|---|---|
| ***A61H 9/00*** | (2006.01) |
| ***A61G 7/057*** | (2006.01) |
| ***A47C 27/10*** | (2006.01) |
| ***A47C 27/18*** | (2006.01) |
| *A47C 21/04* | (2006.01) |

(52) U.S. Cl.

CPC ..... *A61H 9/0078* (2013.01); *A61G 7/05776* (2013.01); *A47C 21/046* (2013.01); *A47C 27/10* (2013.01)

USPC ..... 601/149; 601/150; 5/710; 5/713; 5/714; 5/698; 5/709

(58) Field of Classification Search

CPC ..... A61G 7/05746; A61G 7/05761; A61G 7/05769; A61G 7/05776; A61G 7/05784; A61G 7/05792; A47C 27/081; A47C 27/082; A47C 27/083; A47C 27/084; A47C 27/088; A47C 27/10; A47C 21/046; A61H 9/0078; A61H 9/0085; A61H 9/0092

USPC ..... 601/23, 24, 26, 34, 55, 61, 75, 88, 89, 601/90, 92, 96–98, 100, 105, 134, 601/148–152; 602/13; 5/652, 655.3, 5/710–715, 698, 709

See application file for complete search history.

(56) References Cited

U.S. PATENT DOCUMENTS

| | | | | | |
|---|---|---|---|---|---|
| 3,587,568 | A | * | 6/1971 | Thomas | 601/149 |
| 3,653,083 | A | * | 4/1972 | Lapidus | 5/713 |
| 4,279,044 | A | * | 7/1981 | Douglas | 5/714 |
| 4,905,331 | A | * | 3/1990 | Hochschild, III | 5/682 |
| 5,044,029 | A | * | 9/1991 | Vrzalik | 5/713 |
| 5,249,319 | A | * | 10/1993 | Higgs | 5/714 |
| 5,483,709 | A | * | 1/1996 | Foster et al. | 5/81.1 R |
| 5,509,155 | A | * | 4/1996 | Zigarac et al. | 5/655.3 |
| 5,564,142 | A | * | 10/1996 | Liu | 5/689 |
| 5,598,593 | A | * | 2/1997 | Wolfe | 5/710 |
| 5,619,764 | A | * | 4/1997 | Lopau | 5/713 |

(Continued)

*Primary Examiner* — Valerie L Skorupa

(74) *Attorney, Agent, or Firm* — Cuenot, Forsythe & Kim, LLC

(57) ABSTRACT

A support surface system provides alternating pressure therapy and low air loss therapy simultaneously using a single pump. The system includes a plurality of cells. Each cell has a foam-filled lower chamber and an upper chamber. Fluid communication between the lower and upper chambers is controlled by a normally closed valve that opens if the pressure within the lower chamber exceeds a predetermined threshold pressure. Pressurized air is alternatingly supplied to the lower chambers of a first subset of cells and the lower chambers of a second subset of cells, thereby providing alternating pressure therapy. When the pressure in the lower chamber exceeds the threshold, the valve opens to allow air from the lower chamber to flow into the upper chamber. Air is expelled from the upper chamber through perforations therein, to remove moisture and humidity and possibly reducing the temperature of the micro-climate beneath a patient.

10 Claims, 5 Drawing Sheets

(56) References Cited

U.S. PATENT DOCUMENTS

| | | | | |
|---|---|---|---|---|
| 6,139,512 | A * | 10/2000 | Ricchio | 601/55 |
| 6,148,461 | A * | 11/2000 | Cook et al. | 5/713 |
| 6,269,505 | B1 * | 8/2001 | Wilkinson | 5/713 |
| 6,302,988 | B1 * | 10/2001 | Miller, Sr. | 156/227 |
| 6,591,437 | B1 * | 7/2003 | Phillips | 5/713 |
| 6,775,868 | B1 * | 8/2004 | Mileti et al. | 5/710 |
| 7,412,738 | B2 * | 8/2008 | Chaffee | 5/706 |
| 7,565,709 | B2 * | 7/2009 | Davis | 5/710 |
| 7,694,372 | B1 * | 4/2010 | Boyd | 5/712 |
| 7,975,331 | B2 * | 7/2011 | Flocard et al. | 5/423 |
| 8,220,090 | B2 * | 7/2012 | Gowda | 5/713 |
| 8,413,277 | B2 * | 4/2013 | Davis et al. | 5/710 |
| 2002/0116766 | A1 * | 8/2002 | Stolpmann | 5/710 |
| 2004/0226101 | A1 * | 11/2004 | Lin et al. | 5/710 |
| 2007/0067916 | A1 * | 3/2007 | Poston | 5/691 |
| 2007/0186349 | A1 * | 8/2007 | Lipman et al. | 5/713 |
| 2010/0180384 | A1 * | 7/2010 | Balonick et al. | 5/709 |

* cited by examiner

SUPPORT SURFACE SYSTEM PROVIDING SIMULTANEOUS ALTERNATING PRESSURE AND LOW AIR LOSS THERAPIES

FIELD

Embodiments relate in general to support surfaces and, more particularly, to therapeutic support surfaces.

BACKGROUND

Whenever a patient lays in bed for a prolonged period of time, especially for decreased mobility patients who stay mostly in the same position, the skin tissue of the patient can begin to breakdown. Some of the most common factors that contribute to skin tissue breakdown are continuous pressure on any part of the body, friction or shear on the skin, prolonged moisture against the skin and elevated temperatures. For example, when a portion of the body is subjected to a continuous pressure, the blood supply to skin tissue can be cut off. As a result, the tissue is deprived of oxygen and nutrients, which, in turn, can cause the tissue to begin to die and can cause pressure sores to develop.

There are treatments commonly used to avoid tissue breakdown by avoiding or minimizing the factors that lead to skin tissue breakdown. For instance, alternating pressure therapy is used in support surfaces to address continuous pressure. Alternating pressure therapy involves changing the loading characteristics/pressure points of the support surface. In other words, alternating pressure therapy redistributes pressure in a support surface so that pressure is not constantly concentrated on certain portions of the body (i.e., the boney prominences) of a patient. As a result, the flow of blood and oxygen is not cut off.

Support surfaces adapted to provide alternating pressure therapy are known. In such support surfaces, a plurality of foam-filled air cells is operatively connected to a pump. The pump inflates every other air cell on a given cycle time. Once the inflation time of a first group of air cells is completed, the pump switches to inflating a second group of air cells. The second group of air cells is pressurized while the first group of cells evacuates air back through the pump. The constant changes in relative elevation between the pressurized air cells and the adjacent non-pressurized air cells creates changing points of elevated pressure in localized areas and results in pressure relief and/or pressure redistribution.

To reduce the effects of temperature and moisture, low air loss therapy is used. Low air loss therapy affects the microclimate around the skin, either by direct air flow to the skin or by cooling and reducing the moisture in the support surface itself. As a result, the skin of the patient is less susceptible to maceration and, accordingly, is less prone to damage from tearing from friction or shear.

Low air loss therapy is typically achieved by using spacer fabrics or air permeable materials in a top cover of the support surface. The top cover is connected to a pump. Generally, the pump supplies air into the top cover. The air travels upward through the spacer material. The air flow removes moisture/humidity from below and around the patient. However, one problem with current designs of providing low air loss therapy in a top cover is the uneven distribution of air around the patient. The top cover is depressed under the body and limits the amount of air flow. Also, the air may only enter the top cover at one point, such as at the foot of the bed. As a result, in some cases, little if any air reaches the upper torso of the patient due to air flow constrictions and/or drag. The actual area effectively served by low air loss in such designs is small compared to the area of the bed surface. Higher loaded and/or more deformed areas of the mattress relative to certain zones of the anatomy may actually pinch off the air flow/circulation in those areas which may actually be some of the most critical/at risk areas of the body.

Through utilization of various therapy modes, specific risk factors can be addressed, which can provide beneficial outcomes. It is generally known that providing a plurality of therapies continuously and at the same time to simultaneously address multiple risk factors can favorably affect outcomes better than if a plurality of therapies is only applied sequentially (not simultaneously) but repetitively.

There are all air support surfaces (that is, those that are not filled with any supporting material) on the market today in which both the therapies of alternating pressure and low air loss is combined into a single system with one pump and can be used simultaneously. However, this is not the case for foam mattresses that utilize air cylinders which are filled with foam. Such air/foam systems either require two pumps, one for each therapy. Alternatively, such systems have a single pump but only one therapy can be used at a time. Again, while many systems are available that can provide alternating pressure as well as low air loss therapies in a single support surface, they require the use of one or the other therapy at a time or necessitate multiple pumps.

Thus, there is, therefore a need for a single pump system that integrates low air loss therapy into a conventional foam/air cylinder which also is capable of operating alternating pressure at the same time.

SUMMARY

In one respect, embodiments are directed to a cell for a support surface. The cell includes an outer casing, a lower chamber and an upper chamber. The lower chamber is defined in part by the outer casing. A support material, such as foam, is provided within the lower chamber. The upper chamber can be expandable. The upper chamber has an upper surface that includes one or more perforations formed in it. The one or more perforations permit fluid communication between the upper chamber and the exterior of the cell. A partition separates the lower chamber and the upper chamber. The partition can define a portion of the lower chamber and/or a portion of the upper chamber.

When the pressure in the lower chamber is at and/or above a predetermined threshold pressure, fluid communication between the lower chamber and the upper chamber is permitted such that air from lower chamber can enter the upper chamber. In such case, air is expelled from the upper chamber through the one or more perforations. When the pressure in the lower chamber is below the predetermined threshold pressure, fluid communication between the lower chamber and the upper chamber is restricted.

A spacer can be operatively positioned within the upper chamber. The spacer can prevent the upper surface of the upper chamber from contacting the partition. A first port can be operatively connected to the cell to permit fluid communication with the lower chamber. Thus, pressurized air can be supplied to the lower chamber through the first port. The cell can further include a second port operatively connected to the cell to permit fluid communication with the lower chamber. The second port can be adapted to allow fluid flow into the lower chamber but not out of the lower chamber.

In one embodiment, fluid communication between the lower and upper chambers can be restricted or permitted by a valve. The valve can be operatively positioned between the lower and upper chambers. The valve can be configured so as to be in a normally closed position in which fluid communication between the lower and upper chambers is restricted. The valve can further be configured to be in an open position if the pressure in the lower chamber is at and/or above a predetermined threshold pressure so as to permit fluid communication between the lower and upper chambers. The valve can be responsive to the pressure in the lower chamber.

A fitting can be attached to the partition in any suitable manner. In one embodiment, the fitting can be sealingly attached to the partition. The fitting can hold the valve in operative position between the lower and upper chambers.

The lower chamber can include an air channel in an upper region thereof in an area surrounding the valve. The air channel can be formed by an insert made of open cell foam, preferably very open cell foam. The insert can be made of a material that is more open, more porous and/or more breathable than the support material in at least an upper portion of the lower chamber. The insert can prevent the restriction of air flow in the lower chamber to the valve. In one embodiment, the insert can be made of reticulated foam.

In another respect, embodiments are directed to a support surface system. The system includes a plurality of cells. Each cell includes an outer casing, a lower chamber, an upper chamber and a partition separating the lower chamber and the upper chamber. The partition defines a portion of the lower chamber and a portion of the upper chamber.

The lower chamber is defined in part by the outer casing. The lower chamber can be substantially filled with a support material. The support material can be, for example, foam. Any suitable type of foam can be used.

The upper chamber can be expandable. The upper chamber has an upper surface in which there is a plurality of perforations. The perforations permit fluid communication between the upper chamber and the exterior of the cell.

A valve is operatively positioned between the lower and upper chambers of each cell. The valve restricts or permits fluid communication between the lower and upper chambers. The valve is normally closed such that fluid communication between the lower and upper chambers is restricted. The valve is configured to open upon the pressure in the lower chamber being at and/or above a predetermined threshold pressure. When such a condition is met, the valve can open to permit fluid communication between the lower and upper chambers. As air enters the upper chamber, it can exit the upper chamber through the plurality of perforations. In this way, the support surface system can provide low air loss therapy.

A substantial portion of the valve can be located in the lower chamber. The lower chamber can include an air channel in an upper region thereof in at least an area surrounding the valve. The air channel can be formed by an insert. The insert can be made of open cell foam and, more particularly, very open cell foam. The insert can be made of a material that is more open, more porous and/or more breathable than the support material in at least an upper portion of the lower chamber. For instance, the insert can be made of foam, including, for example, reticulated foam. The insert can prevent the restriction of air flow in the lower chamber to the valve.

A first port is operatively connected to the cell to permit fluid communication with the lower chamber. Pressurized air can be supplied to the lower chamber through the first port. In some instances, a second port can be operatively connected to the cell to permit fluid communication with the lower chamber. The second port can be adapted to allow fluid flow into the lower chamber but not out of the lower chamber. Thus, air can enter into the lower chamber through the second port when the cell is not being pressurized and a patient moves on the support surface.

The plurality of cells includes a first subset and a second subset. The plurality of cells is arranged so that the cells of the first subset alternate with the cells of the second subset. As a result, pressurized air can be alternatingly supplied to the first subset of cells and the second subset of cells. In this way, the support surface system can provide alternating pressure therapy.

The system can further include a spacer operatively positioned within the upper chamber. The spacer can prevent the upper surface of the upper chamber from contacting the partition.

The system can include a top support that is at least partially supported on the plurality of cells. The top support can be made of a breathable material so as to allow air exiting the upper chamber of the cells to pass through it. The top support can be at least partially deformable. Thus, the top support can deform in response to expansions and contractions of the upper chambers of the plurality of cells. The system may further include a fire barrier that can enclose the top support and the plurality of cells. The fire barrier can be made of a breathable material. As a result, air exiting through the perforations can flow through the fire barrier.

The system can further include a pump. The pump can have a first pump outlet and a second pump outlet. The first pump outlet can be operatively connected to the first port of the first subset of the plurality of cells, such as by a conduit. Thus, air from the first pump outlet can be supplied to the lower chamber of each of the first subset of the plurality of cells. The second pump can be operatively connected to the second port. For instance, the second pump outlet can be operatively connected to the first port of at least one of the second subset of cells by a conduit. Air from the second pump outlet can be supplied to the lower chamber of each of the second subset of the plurality of cells.

The pump can be configured to discharge pressurized air out of only one of the first pump outlet and the second pump outlet at a time. The pump can be configured to alternatingly supply pressurized air to the first subset of the plurality of cell and the second subset of the plurality of cells on a timed basis. In one embodiment, the first ports of the first subset of cells can be operatively connected in series with the first pump outlet, and the first ports of the second subset of cells can be operatively connected in series with the second pump outlet.

DETAILED DESCRIPTION

Figure 1:
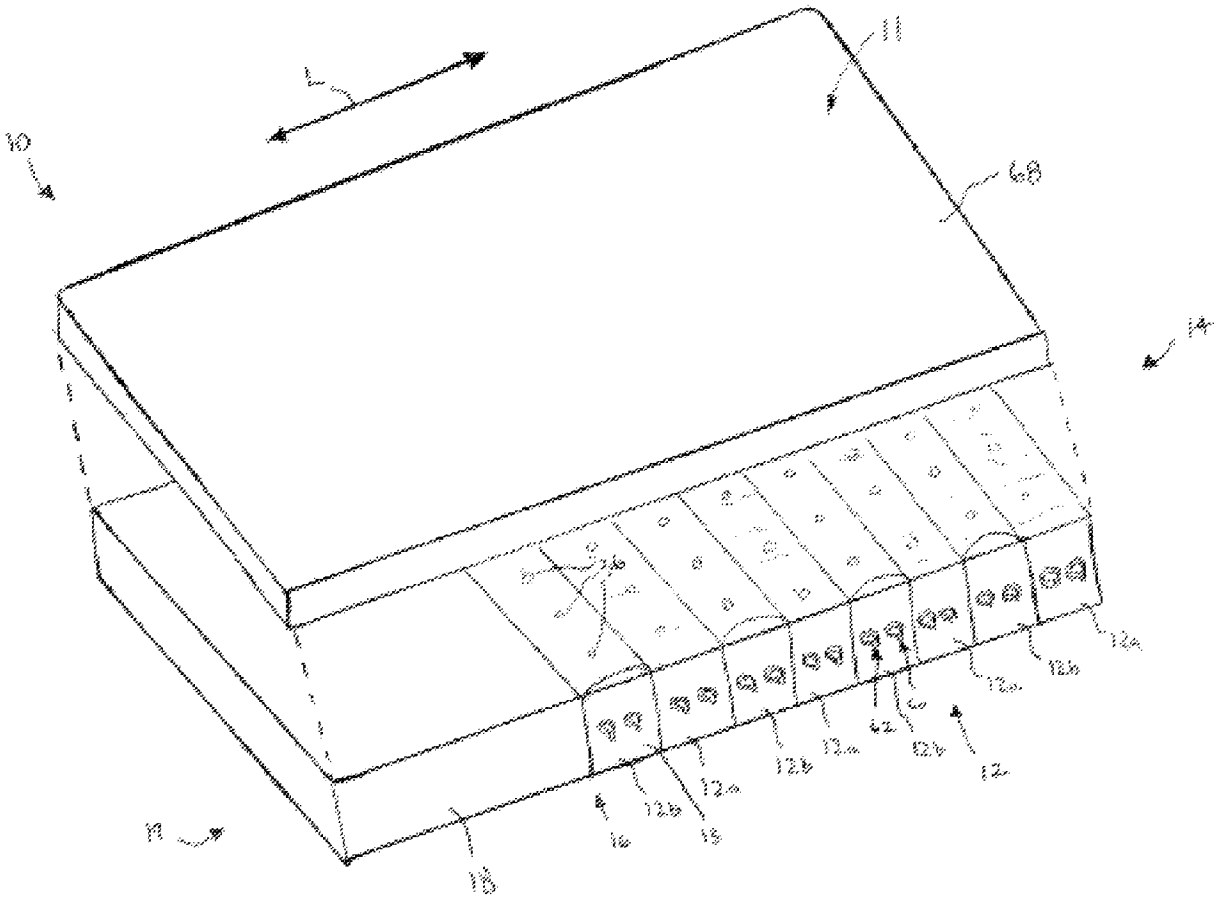
FIG. 1 is a perspective exploded view of a portion of a support surface system having a plurality of cells.

Embodiments are directed to a support system and an associated manner of operating the support system. Aspects will be explained in connection with one possible system, but the detailed description is intended only as exemplary. Embodiments are shown in FIGS. 1-5, but the embodiments are not limited to the illustrated structure or application. It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details.

Embodiments are directed to a support surface system 10 that can simultaneously provide alternating pressure therapy and low air low therapy to a patient supported on a support surface 11 thereof. The support surface system 10 can include a plurality of cells 12. Each cell 12 can be elongated. The cells 12 can have any suitable shape. In one embodiment, the cells 12 can be generally rectangular. The plurality of cells 12 can be substantially identical to each other, or at least one of the cells 12 can be different from the other cells 12 in one or more respects.

There can be any suitable quantity of cells 12. In one embodiment, there can be 8 cells 12. The cells 12 can be arranged so that they abut each other. However, in some instances, there may be a slight spacing between at least one pair of neighboring cells 12. The one or more pairs of neighboring cells 12 can be attached to each other in any suitable manner.

The cells 12 can be oriented in any suitable manner. As shown in FIG. 1, the cells 12 can be arranged generally perpendicular to the longitudinal direction L of the support surface 11, that is, generally perpendicular to the length of a patient who lay on the support surface 11. In other embodiments, the cells 12 can be generally parallel to the longitudinal direction L of the support surface 11, that is, generally parallel to the length of a patient who lay on the support surface 11.

The cells 12 can be provided along the entire length of the support surface 11. Alternatively, the cells 12 may be provided along less than the entire length of the support surface 11. For instance, the cells 12 may be provided beginning at the head end 14 of the support surface 11 through a lower body region 16 of the support surface system 10, which can correspond to the thighs, knee or an area above the knee of a patient lying on the bed. In such case, a foam footer piece 18 can be provided at a footer region 19 of the support surface 11 to support the lower legs and feet of the patient.

Figure 2:
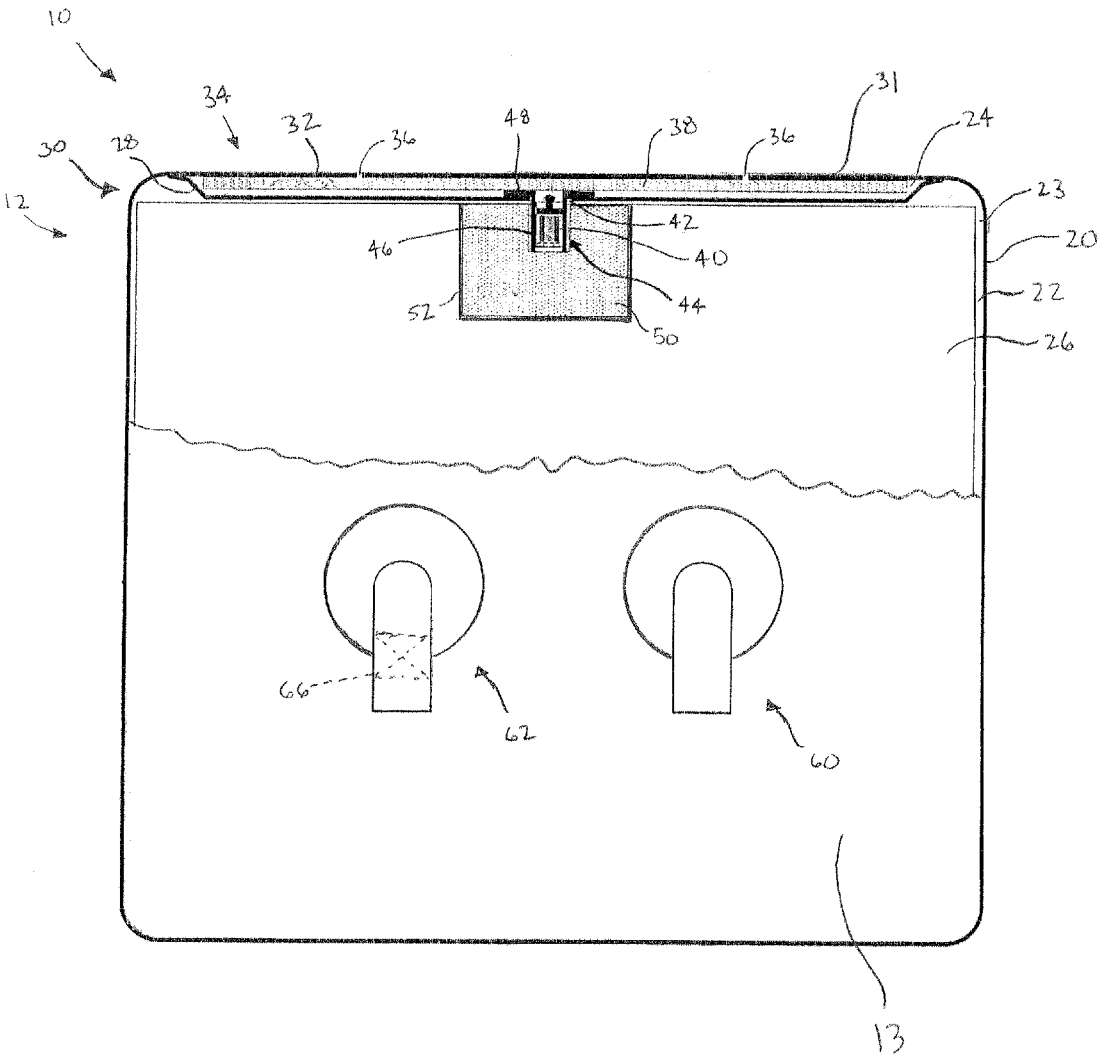
FIG. 2 is a side elevation partial cross-section view of a cell having a lower chamber and an upper chamber.

FIG. 2 shows an example of one of the plurality of cells 12. Each of the plurality of cells 12 can include an outer casing 20. The outer casing 20 can define the general shape of the cell 12. The outer casing 20 can be made of any suitable material so as to create an air-tight barrier. In one embodiment, the outer casing 20 can be made of nylon covered with PVC. The outer casing 20 can be substantially rigid such that it can substantially retain its shape when filled with pressurized air.

Each of the cells 20 can have a lower chamber 22 and an upper chamber 24. The upper chamber is located above the lower chamber. The terms "upper" and "lower" mean relative to the ground. A support material can be provided within the lower chamber 22. In one embodiment, the lower chamber 22 can be substantially filled with a support material. In one embodiment, the support material can be foam 26. Any suitable foam can be used. The same type of foam can be used throughout the lower chamber, or different foams can be used. For instance, firm foam can be used toward the bottom of the lower chamber 22, and soft foam can be used toward the top of the lower chamber 24. One or more medium foams may or may not be used in between the soft and firm foams.

The inclusion of support material in the lower chamber 22 can be beneficial in instances in which one or more of the cells 12 ruptures. In such instances, the support material can still allow the cell 12 to function as a viable support surface. Thus, the support material can serve as a failsafe mechanism.

The upper chamber 24 can be formed in any suitable manner. A partition 28 can be attached at or near its periphery to an upper end 30 of the outer casing 20. Thus, the partition 28 can close the lower chamber 22. More particularly, the partition 28 can sealingly close the lower chamber 22. The partition 28 can define a portion of the lower chamber 22 as well as a portion of the upper chamber 24. The partition 28 can be made of any suitable material. For example, the partition 28 can be made of urethane. The partition 28 can be provided in any suitable form, such as in the form of a film.

The lower chamber 22 can be expandable. More particularly, the lower chamber 22 can be expandable in at least an upward direction. The term expandable means that the lower chamber 22 can change in shape with or without a change in the overall volume enclosed within. The lower chamber 22 can be expandable in any suitable manner. For instance, the partition 28 can be flexible. When the lower chamber 22 is filled with air, the partition 28 can expand outward, such as by flexing or bowing, to accommodate the air, if necessary. FIG. 1 shows the partitions 28 of a first subset of cells 12*a* being in an expanded condition whereas the partitions 28 of a second subset of cells 12*b* being in a non-expanded condition.

The upper chamber 24 can include an upper surface 31. The upper surface 31 can be defined by any suitable structure. In one embodiment, the upper surface can be defined at least in part by a top panel 32. The top panel 32 can be attached to the partition 28 and/or to the upper end region 30 of the outer casing 20. The top panel 32 can be provided in any suitable form, such as in the form of a film. Any suitable form of attachment can be used, including, for example, by welding, radio frequency welding, mechanical engagement, fasteners and/or adhesives. The top panel 32 can be made of any suitable material. For instance, the top panel 32 made of PVC-coated nylon or thermoplastic polyurethane. When the top panel 32 is made of a fibrous material, it can have any suitable fiber density and may have an associated denier. The top panel 32 can be made of a material that is impervious to air.

The top panel 32 can define a portion of the upper chamber 24 as well as an upper end 34 of the cell 12.

At least a portion of the top panel 32 can be configured to allow air to pass therethrough. For instance, the top panel 32 can include one or more perforations 36, as is shown in FIG. 2. The perforations 36 can permit fluid communication between the upper chamber 24 and the exterior of the cell 12. The perforations 36 can have any suitable size and shape. In one embodiment, the perforations 36 can be substantially circular. The perforations 36 can be substantially identical to each other in size and shape, or at least one of the perforations 36 can be different from the other perforations 36 in one or more respects.

The perforations 36 can be distributed in the top panel 32 in any suitable manner. In one embodiment, the perforations 36 can be arranged in a row along the length of the cell 12, as is shown in FIG. 1. Alternatively, at least one of the perforations 36 can be offset from the other perforations 36. The plurality of perforations 36 can be substantially equally spaced, or the spacing between the perforations 36 can vary. The distribution of the perforations 36 in the top panel 32 may be the same for the plurality of the cells 12. Alternatively, the distribution of the perforations 36 in the top panel 32 of at least one of the cells 12 can be different from the distribution of the perforations 36 in the top panel 32 of one or more of the other cells 12. Similarly, the quantity of perforations 36 provided in the top panel 32 may be the same of the plurality of cells 12. Alternatively, the quantity of perforations 36 in the top panel 32 of at least one of the cells 12 can be different from the quantity of perforations 36 in the top panel 32 of one or more of the other cells 12.

The upper chamber 24 can be expandable. More particularly, the upper chamber 24 can be expandable in at least an upward direction. The term expandable means that the upper chamber 24 can change in shape with or without a change in the overall volume of the upper chamber 24. For instance, the top panel 32 can be flexible. When the upper chamber 24 is filled with air, the top panel 32 can expand outward, such as by flexing or bowing. Such outward expansion may be responsive to the expansion of the lower chamber 22. For instance, the outward bowing of the partition 28 can cause the top panel 32 to bow outward. Alternatively or in addition, such outward expansion may be the result of air filling the upper chamber 24, as may occur when the rate at which air enters the upper chamber 24 exceeds the rate at which air is expelled from the upper chamber 24 through the perforations 36. FIG. 1 shows the top panels 32 of a first subset of cells 12*a* being in an expanded condition whereas the top panels 32 of a second subset of cells 12*b* being in a non-expanded condition. In some instances, the amount which the top panel 32 expands may be less that the amount which the partition 28 expands. In some embodiments, the lower chamber 22 may not be expandable.

To prevent the top panel 32 and the partition 28 from contacting each other and thereby potentially blocking air flow in the upper chamber 24, a spacer 38 can be provided in the upper chamber 38. The spacer 38 can extend within at least a portion of the upper chamber 24. In one embodiment, the spacer 38 can extend along substantially the entire expanse of the chamber 24. The spacer 38 may be made of any suitable breathable material, that is, a material that can allow the passage of air through it. For instance, the spacer 38 can be made of reticulated foam, open cell foam, honeycomb woven material or fabric. In one embodiment, the spacer 38 can be made of Stimulite, which is available from Supracor, Inc., San Jose, Calif. Generally, the spacer 38 can be made of any suitable, breathable material with sufficient strength to maintain sufficient spacing between the top panel 32 and the partition 28 to allow for substantially unobstructed air flow in the upper chamber 24.

The lower chamber 22 and the upper chamber 24 can be in fluid communication with each other only under certain conditions. For instance, the lower chamber 22 can be in fluid communication with the upper chamber 24 once the pressure in the lower chamber 22 is at or above a predetermined pressure threshold. Such fluid communication can be achieved in any suitable manner, such as by operatively positioning a structure between the lower and upper chambers 22, 24 that is normally closed so as to prevent fluid communication between the lower chamber 22 and the upper chamber 24. When the pressure in the lower chamber 22 reaches and/or exceeds a predetermined pressure threshold, the structure can open to permit fluid communication between the lower chamber 22 and the upper chamber 24. When the pressure in the lower chamber 22 is at or below a predetermined pressure threshold, the structure can close to prevent fluid communication between the lower chamber 22 and the upper chamber 24.

In one embodiment, the structure can be a valve 40 can be operatively positioned between the lower and upper chambers 22, 24. The valve 40 can be any suitable type of valve, including, for example, a cracking valve or a check valve. The valve 40 is normally in a closed position, but, when the pressure in the lower chamber 22 reaches or rises above a predetermined pressure threshold, the valve 40 can move to an open position, thereby allowing fluid communication between the lower chamber 22 and the upper chamber 24. The valve 40 may be configured to allow fluid flow in only one direction, such as only from the lower chamber 22 to the upper chamber 24.

Any suitable quantity of valves can be used. In one embodiment, only a single valve 40 may be used. In another embodiment, there can be a plurality of valves 40. In such case, the valves 40 can be distributed in any suitable manner. For instance, the plurality of valves 40 can be arranged in a row along the length of the cell 12. Alternatively, at least one of the valves 40 can be offset from the other valves 40. The plurality of valves 40 can be substantially equally spaced. Alternatively, the spacing between valves 40 can be different. The location/distribution of the one or more valves 40 may be the same in each of the plurality of the cells 12. Alternatively, the location/distribution of the one or more valves 40 of at least one of the cells 12 can be different from the location/distribution of the one or more valves 40 in one or more of the other cells 12.

In the case of a plurality of valves 40, the valves 40 may or may not be the same type of valve or may differ in one or more respects. The quantity of valves 40 associated with each cell 12 may be the same for the plurality of cells 12. Alternatively, the quantity of valves 40 associated with at least one of the cells 12 can be different from the quantity of valves 40 associated with one or more of the other cells 12.

The valve 40 can return to the closed position once the pressure in the lower chamber 22 decreases to or below the predetermined pressure threshold. The predetermined pressure threshold can be set at any suitable level. In one embodiment, the predetermined pressure threshold can be from about 0.5 psi to about 1.5 psi. In one embodiment, the predetermined pressure threshold can be about 0.75 psi. In another embodiment, the predetermined pressure threshold can be about 1.25 psi.

The valve 40 itself can be adapted to be responsive to the pressure in the lower chamber 22. In one embodiment, the valve 40 can include a mechanism, such as a spring (not shown), that is responsive to the pressure in the lower chamber 22. For instance, once the predetermined pressure threshold is reached or exceeded, the spring may be sufficiently compressed to move off of a seal (not shown) and thereby allow flow through the valve 40. Alternatively, a sensor (not shown) can be used to determine the pressure in the lower chamber 22. The sensor can be operatively connected to control the opening and the closing of the valve 40 based on the determined pressure in the lower chamber 22.

As noted above, the valve 40 can be operatively positioned between the lower and upper chambers 22, 24. Such operative positioning can be achieved in any suitable manner. In one embodiment, a hole 42 can be provided in the partition 28. The hole 42 can have any suitable size and shape. A fitting 44 can be provided to facilitate the interface between the hole 42 and the valve 40. The fitting 44 can sealingly engage the partition 28 to prevent the leakage of air across the interface between the fitting 44 and the partition 28.

In one embodiment, the fitting 44 can be a straight fitting having a sleeve portion 46 and a flange portion 48. The sleeve portion 46 can be inserted into the hole 42 until the flange portion 48 engages the partition 28. The flange portion 48 can be attached to the partition 28 in any suitable manner, including, for example, by welding, radio frequency welding, adhesives and/or fasteners. In one embodiment, the flange portion 48 can be sealingly attached to the partition 28 to prevent the leakage of air across the interface between the fitting 44 and the partition 28. The fitting 44 can be made of any suitable material, including, for example, PVC or urethane.

The sleeve portion 46 of the fitting 44 can extend into the lower chamber 22. The valve 40 can be received in the sleeve portion 46 of the fitting 44. The valve 40 can be retained in the sleeve portion 46 in any suitable manner. For example, the valve 40 can be retained in the sleeve portion 46 by fasteners, mechanical engagement, welding and/or adhesives, just to name a few possibilities. In one embodiment, the fitting 44 and the valve 40 can be sized so that the valve 40 must be press fit into the sleeve portion 46. In such case, the valve 40 may be held in place solely by engagement with the sleeve portion 46. In one embodiment, a substantial portion of the valve 40 can be located within the lower chamber 22.

The foam 26 in the lower chamber 22 may be soft, at least in an upper portion 23 thereof, so as to provide suitable pressure relief to a patient who lay on the mattress. However, soft foam may compress and interfere with or effectively eliminate fluid flow to the valve 40. To minimize this possibility, an air channel can be provided to ensure fluid communication to the valve 40. The air channel can be formed in any suitable manner. In one embodiment, the valve 40 can be surrounded by an insert 50 in the lower chamber 22.

The insert 50 can be made of any suitable material. The insert 50 can be made of a material that is more open in structure, more breathable and/or more porous than the foam in at least an upper portion 23 of the lower chamber 22. The insert 50 can be made of open cell foam, preferable very open cell foam. Reticulated foam is one example of a suitable very open cell foam structure. The insert 50 can ensure that the air channel permitting fluid communication between the lower chamber 22 and the vale and/or between the lower chamber 22 and the upper chambers 24 is not substantially restricted when subjected to the expected patient imposed loads on the support surface 11. Thus, the insert 50 can provide a substantially consistent and controlled geometry for an air channel to the valve 50.

In one embodiment, the insert 50 can extend along substantially the entire length of the cell 12. For example, the insert 50 can extend substantially to one or both of the lateral ends 13 of the cell 12. Such an arrangement can be advantageous because it can ensure that air can at least enter through the lateral ends 13 of the cell 12. However, in other instances, the insert 50 may be provided only in the local area surrounding the valve 40.

The insert 50 can be received in an open space 52 provided in the foam 26 in the lower chamber 22. The insert 50 can be configured for substantially mating engagement with the open space 52 in the foam 26. The insert 50 may simply reside within the open space 52 and be held therein by its substantially mating engagement with the foam 26. Alternatively or in addition, the insert 50 can be held in place by other means, including, for example, by an adhesives and/or fasteners.

A support surface system 10 can include a single pump 54 that is operatively connected to deliver air or other suitable fluid to the cells 12. Any suitable type of pump 54 can be used. The pump 54 can include a first pump outlet 56 and a second pump outlet 58. The pump 54 can be configured to discharge air to only one of the outlets 56, 58 at a time. In some instances, the pump 54 may also be configured to discharge air to both of the outlets 56, 58 at the same time.

The pump 54 can be operatively connected to permit fluid communication with the lower chamber 22 of each cell 12. The pump 54 can be operatively connected to the cells 12 in any suitable manner to provide alternating pressure therapy. Each cell 12 can have a first port 60 and a second port 62. The first and second ports 60, 62 can be any suitable structure, including for example 90 degree elbows. The first and second ports 60, 62 may or may not be the same structure. Each of the ports 60, 62 can be attached to the cells 12 in any suitable manner. For instance, each of the ports 60, 62 can be attached to the outer casing 20 of the respective cell 12 in any suitable manner, such as by welding, radio frequency welding, mechanical engagement, fasteners and/or adhesives.

The ports 60, 62 can be provided in any suitable location on the cell 12. In one embodiment, the ports 60, 62 can be provided in a substantially central region of the cell 12, as is shown in FIG. 2. Alternatively, the ports 60, 62 can be provided in the lower half region of the cell 12. The ports 60, 62 can be provided at substantially the same elevation on the cell 12, as is shown in FIG. 2. Alternatively, the ports 60, 62 may be provided at different elevations on the cell 12.

Figure 3:
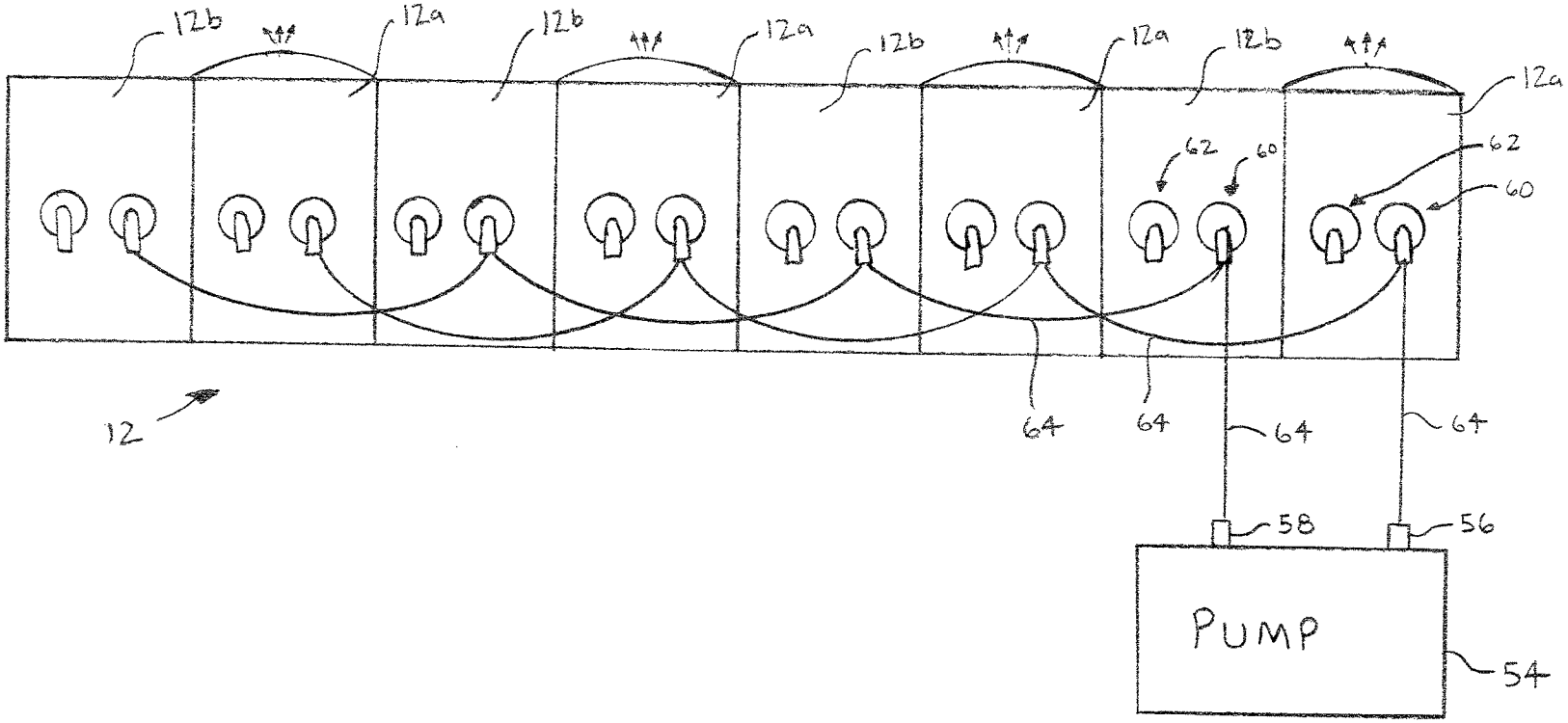
FIG. 3 is a side elevation view of a plurality of cells being operatively connected to a single pump.

In one embodiment, the first pump outlet 56 can be operatively connected in fluid communication with a first subset 12*a* of the plurality of cells 12, and the second pump outlet 58 can be operatively connected in fluid communication with a second subset 12*b* of the plurality of cells 12, as is shown in FIG. 3. The cells 12 can be arranged such that the cells 12 in the first subset 12*a* alternate with the cells 12 in the second subset 12*b*. Again, the cells 12 in the first subset 12*a* can be substantially identical to the cells 12 in the second subset 12*b;* however, the first subset of cells 12*a* can operatively engage the pump 54 differently than the second subset of cells 12*b*.

The first pump outlet 56 can be operatively connected in fluid communication with the first ports 60 of the first subset 12*a* of the plurality of cells 12, and the second pump outlet 62 can be operatively connected in fluid communication with the first ports 60 of the second subset 12*b* of the plurality of cells 12. Such operative connection can be achieved in any suitable manner, such as by conduits 64. Any suitable conduits 64 can be used, such as tubing.

In one arrangement, the first subset 12*a* of the plurality of cells 12 can be operatively connected in series, as is shown in FIG. 3. Such a series connection can be achieved in several ways. In one example, a conduit 64 can extend from the pump 54 to the first port 60 of a respective one of the first subset 12*a* of the plurality of cells 12. A flow divider, such as a T-fitting (not shown), can be operatively associated with the first port 60. The conduit 64 can be operatively connected to one of the legs of the T-fitting. Another one of the legs of the T-fitting can be in fluid communication with the first port 60. A conduit of a third leg of the T-fitting can be in fluid communication with one of the legs of a T-fitting that is operatively associated with the first port 60 of another one of the first subset 12*a* of the plurality of cells 12, such as by another conduit 64. Such an arrangement can continue among all of the cells 12 of the first subset 12*a* of the plurality of cells 12. The final cell 12 in the series can be equipped with an elbow or straight connector or no connector at all. The second subset 12*b* of the plurality of cells 12 can be operatively connected in series in a similar manner. As an alternative, the first subset 12*a* of the plurality of cells 12 can be operatively connected in parallel to the first pump outlet 56. Alternatively or in addition, the second subset 12*b* of the plurality of cells 12 can be operatively connected in parallel to the second pump outlet 58.

The second port 62 of each cell 12 can be adapted to allow air to flow into the lower chamber 22 of the respective cell 12 but not out of the lower chamber 22 of the cell 12. Such an arrangement can be achieved in any suitable manner, such as by operatively positioning a suitable valve 66 (FIG. 2) with respect to the second port 62. In one embodiment, the valve 66 can be a check valve that is operatively positioned within the second port 62, such as by press-fitting. The check valve can permit the flow of air in only one direction. Thus, air can be allowed to enter or wick into the cells 12 when they are not being pressurized and a patient moves on the support surface 11. Air cannot exit the cells 12 through the valve 66.

The pump 54 can be configured to cycle between the first and second outlets 56, 58 in any suitable manner. For instance, such cycling can be achieved by a suitable valve (not shown), which can be, for example, a rotary valve. The cycling between the first and second outlets 56, 58 can be done in any suitable manner. For instance, the cycling can be done on a timed basis. The amount of time in which the pump 54 discharges to the first outlet 56 may or may not be the same as the amount of time the pump 54 discharges to the second outlet 58. The amount of time in which the pump 54 discharges to the outlets 56, 58 may vary during the operational period. The valve can be mechanical based, or it can be operated by an electronic controller. In some instances, the pump 54 may discharge to the first and second outlets 56, 58 simultaneously to thereby inflate the lower chambers 22 of all of the cells 12.

Figure 4:
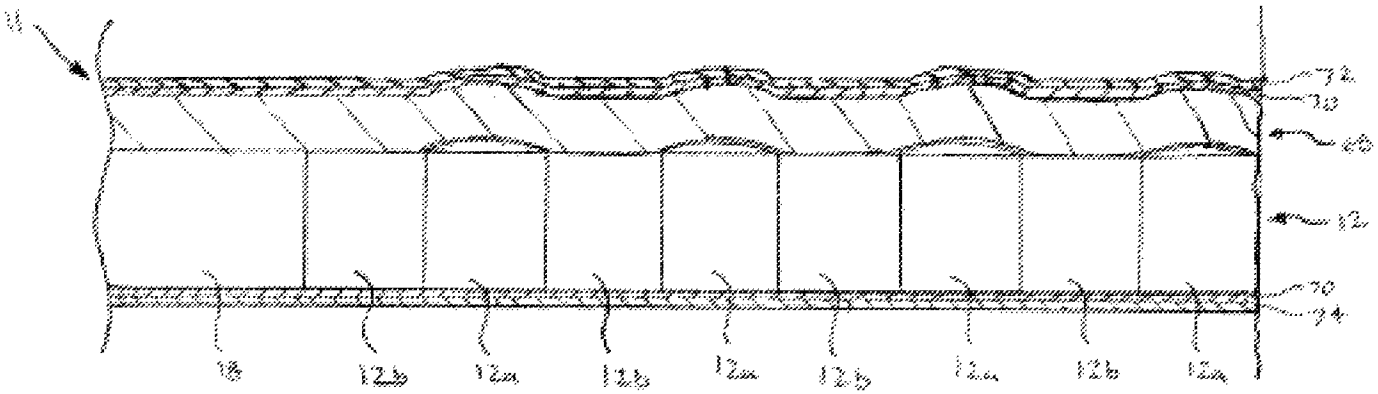
FIG. 4 is a side elevation partial cross-section view of a portion of a support surface system, showing a first subset of the plurality of cells being pressurized.

Referring to FIG. 4, a top support 68 can be placed on top of the cells 12 and the footer piece 18 or other support, if provided. The top support 68 can be adapted to spread out the load of the patient laterally and/or radially to a wider area. The top support 68 can be made of any suitable material, including, for example, foam. The properties of the material can be selected depending on the application. The material can be breathable to allow air exiting from the cells 12 to flow therethrough. The top support 68 can be deformable such that variations in the height of the cells 12, as caused by the inflation and deflation of the cells 12, can affect the contour of the top support 68, as is shown in FIG. 4.

The top support 68, the cells 12 and the footer piece 18 or other support can be enclosed within a fire barrier 70 (FIG. 4) or fire sock. The fire barrier 70 can be any suitable fire retardant material and one that is breathable, that is, one that allows the passage of air therethrough. The fire barrier 70 can have an open end (not shown) to receive the top support 68, the cells 12 and the footer piece 18 or other supports. The open end can be closed in any suitable manner. One or more openings (not shown) can be provided in the fire barrier 70 to allow access to the first and second ports 60, 62 of the cells 12.

A top cover 72 (FIG. 4) can be placed over at least an upper portion of the support surface 11. The top cover 72 can be made of a substantially air impervious material to minimize the passage of air therethrough. The top cover 72 can be adapted to be impervious to water. A bottom cover 74 (FIG. 4) can be placed over a lower portion of the enclosed assembly. The bottom cover 74 can be made of any suitable material. For instance, the bottom cover 74 can be made of a non-stretchable and form holding material. The bottom cover 74 may or may not be breathable. In one embodiment, the bottom cover 74 can be made of a PVC coated nylon material.

Now that the details of the support surface system have been described, one manner of using the system will now be explained. It will be understood that the following description is provided as only an example, and embodiments are not limited to any particular method of use.

The pump 54 can be activated so as to supply air to only the first subset 12*a* of the plurality of cells 12. More particularly, air is supplied to the lower chamber 22 of each of these cells 12. The pressure in the lower chamber 22 of the cells 12 will naturally increase, as the valve 40 between the lower chamber 22 and the upper chamber 24 is closed to prevent fluid communication therebetween. Accordingly, no air is received in the upper chambers 24 of the cells 12. Thus, while the lower chamber 22 is initially being pressurized, the upper chamber 24 is not pressurized. However, when pressure in the lower chamber 22 of these cells 12 increases to and/or above a predetermined pressure threshold, the valve 40 can open to permit fluid communication between the lower and upper chambers 22, 24. The air in the lower chamber 22 can pass through the valve 40 and into the upper chamber 24. As a result, the upper chamber 24 may expand, such as by the top panel 32 bowing outward.

Figure 5:
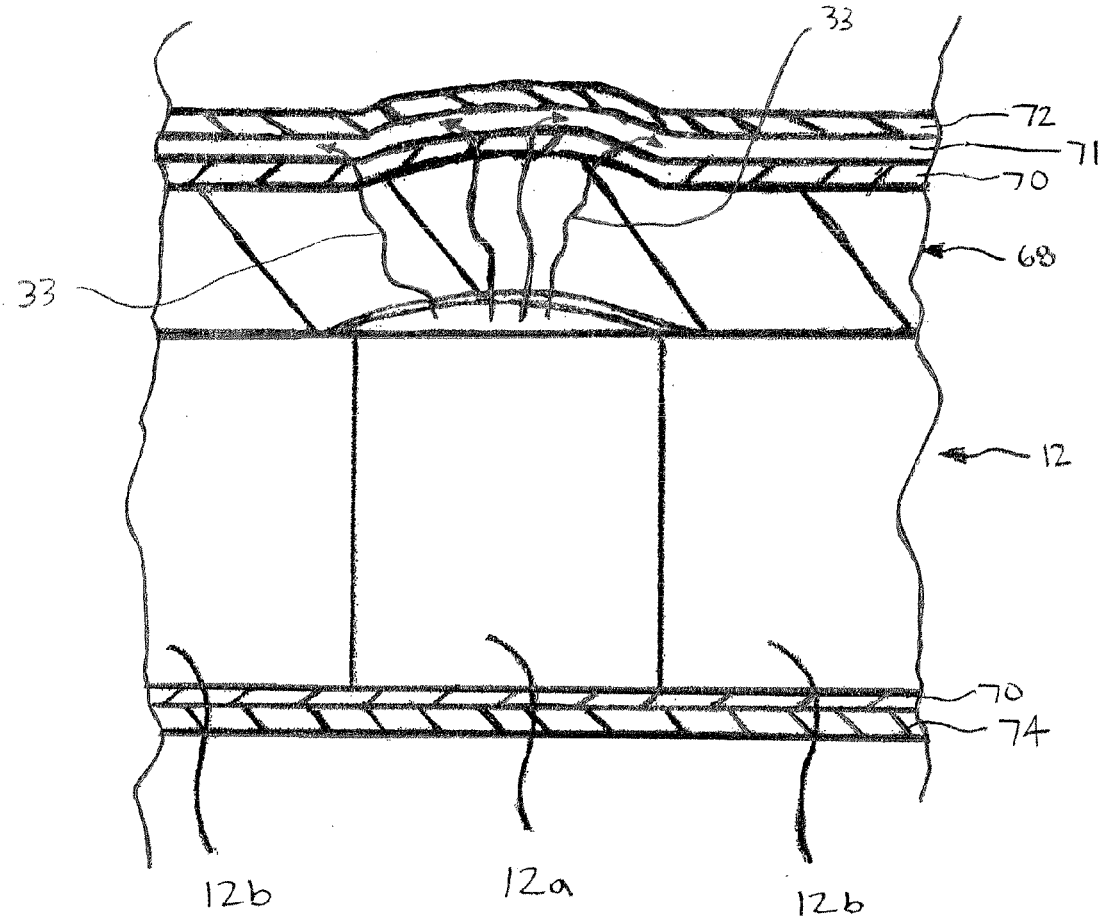
FIG. 5 is a side elevation partial cross-section view of a portion of a support surface system, showing air exiting the upper chamber of a cell passing through a top support and fire barrier and into a space between the fire barrier and a top cover.

As noted above, there are perforations 36 in the top panel 32. Thus, air 33 that is received in the upper chamber 24 is expelled through these perforations 36, as is shown in FIG. 5. After exiting the cells 12, the air 33 can then flow through the top support 68 and the fire barrier 70, as is shown in FIG. 5. After exiting the fire barrier 70, the air can enter and circulate within the space between the top cover 72 and the fire barrier 70. The air can circulate in sufficient volume and/or space below the area directly below the patient.

The air 33 can affect the micro-climate of the patient. Moisture can develop in the area 71 between the patient's body and the top cover 72. Some of the moisture, in the form of vapor, can transfer through the top cover 72. The flow of the air 33 in the area 71 can dissipate moisture that transfers through the top cover 72. The substantially continuous and increased flow of air 33 can improve the micro-climate or environment for the skin by removing moisture and humidity. The volume of air and area of air circulation can potentially reduce the temperature of the patient's micro-climate, thereby minimizing further moisture formation.

In this way, low air loss therapy is provided by the support surface system described herein. It will be appreciated that low air loss therapy is provided across a large portion of the support surface, as air is being expelled from the upper chamber 24 in each of the first subset 12*a* of the plurality of cells 12. Thus, air can be more evenly distributed throughout the support surface 11. Each cell 12 can provide the same amount of low air loss therapy.

When the pressure in the lower chamber 22 drops to or below the predetermined pressure, the valve 40 can close, allowing the lower chamber 22 to at least partially refill with air. This prevents the cells 12 from becoming overly deflated, in which case the alternating pressure therapy of the system may become less effective. While the pump 54 is supplying air out of the first pump outlet 56, the upper chamber 24 of the first subset of cells 12*a* may inflate and deflate one or more times.

Eventually, the pump 54 can switch to supply air to only the second subset 12*b* of the plurality of cells 12. More particularly, air can be supplied to the lower chamber 22 of each of these cells 12. The above-described operation of the cells 12 in the first subset 12*a* applies equally to the cells 12 in the second subset 12*b*. Air remaining in the lower chamber 22 of the first subset 12*a* of the plurality of cells 12 may be vented to the pump 54 by way of the conduits 64. This cycling of alternating inflation and deflation of the plurality of cells 12 can provide alternating pressure therapy to a patient on the support surface 10. The pump 54 will again switch to supplying air to only the first subset 12*a* of the plurality of cells 12. Such cycling can continue uninterrupted. In some instances, the pump 54 may supply air to both the first subset 12*a* and the second subset 12*b* of the plurality of cells 12 simultaneously. Further, by locating the ports 60, 62 at or below a substantially central region of the cell 12, it likelihood that flow to and from the ports 60, 62 will be restricted under patient loading is minimized.

Thus, it will be appreciated that embodiments of a support surface system 10 described herein can result in significant advantages and benefits. The system 10 integrates continuous and simultaneous alternating pressure and low air loss therapies into foam filled air cylinders in a support surface. By providing continuous and greater air flow surface area from the low air loss therapy aspect of the system, the environment for the skin can be improved. At the same time, the alternating pressure aspect of the system can relieve pressure points and prevent the formation of pressure sores. The air from the low air loss therapy can be distributed evenly throughout the entire support surface, thereby increasing the effectiveness of the therapy. The system can achieve these simultaneous benefits using only a single pump, thereby minimizing the cost and number of parts in the system.

Examples have been described above regarding a support surface system and a method of operating such a system. It will of course be understood that embodiments are not limited to the specific details described herein, which are given by way of example only, and that various modifications and alterations are possible within the scope of the following claims.

What is claimed is:

1. A support surface system comprising:

a plurality of cells, each cell comprising:

an outer casing;

a lower chamber defined in part by the outer casing, a support material being provided within the lower chamber;

an upper chamber having an upper surface having a plurality of perforations therein, the perforations permitting fluid communication between the upper chamber and an exterior of the cell;

a partition separating the lower chamber and the upper chamber, the partition defining a portion of the lower chamber and a portion of the upper chamber;

a valve operatively positioned between the lower and upper chambers for restricting or permitting fluid communication therebetween, the valve being configured so as to be in a normally closed position so as to restrict fluid communication between the lower and upper chambers, and the valve further being configured to open upon the pressure in the lower chamber being at or above a predetermined threshold pressure so as to permit fluid communication between the lower and upper chambers; and a first port operatively connected to the cell to permit fluid communication with the lower chamber, whereby pressurized air can be supplied to the lower chamber through the first port, the plurality of cells including a first subset and a second subset, the plurality of cells being arranged so that the cells of the first subset alternate with the cells of the second subset, whereby pressurized air is alternatingly supplied to the first subset of cells and the second subset of cells to provide alternating pressure therapy.

2. The system of claim 1 wherein the support material is foam.

3. The system of claim 1 further including a spacer operatively positioned within the upper chamber, whereby the spacer prevents the upper surface of the upper chamber from contacting the partition.

4. The system of claim 1 further including a second port operatively connected to the cell to permit fluid communication with the lower chamber, wherein the second port is adapted to allow fluid flow into the lower chamber but not out of the lower chamber, whereby air can enter into the lower chamber through the second port when the cell is not being pressurized and a patient moves on the support surface.

5. The system of claim 1 wherein a substantial portion of the valve is located in the lower chamber, and wherein the lower chamber includes an insert in an upper region thereof in at least an area surrounding the valve, the insert providing an air channel between the valve and the lower chamber, whereby the air channel prevents the restriction of air flow from the lower chamber to the valve.

6. The system of claim 1 further including a top support that is at least partially supported on the plurality of cells, wherein the top support is made of a breathable material and is at least partially deformable, whereby the top support allows air exiting the upper chamber of the cells to pass therethrough and deforms in response to expansions and contractions of the upper chambers of the plurality of cells.

7. The system of claim 6 further including a fire barrier enclosing the top support and the plurality of cells, the fire barrier being made of a breathable material, whereby air exiting through the perforations can flow through the fire barrier.

8. The system of claim 1 further including a pump, the pump having a first pump outlet and a second pump outlet, wherein the first pump outlet is operatively connected to the first port of the first subset of the plurality of cells so as to supply pressurized air to the lower chamber of each of the first subset of the plurality of cells, and the second pump is operatively connected to the second port to supply pressurized air to the lower chamber of each of the second subset of the plurality of cells, wherein the pump is configured to discharge pressurized air out of only one of the first pump outlet and the second pump outlet at a time, and wherein the pump is configured to alternatingly supply pressurized air to the first subset of the plurality of cell and the second subset of the plurality of cells on a timed basis.

9. The system of claim 8 wherein the first ports of the first subset of cells are operatively connected in series with the first pump outlet, and wherein the first ports of the second subset of cells are operatively connected in series with the second pump outlet.

10. The system of claim 8 wherein the first pump outlet is operatively connected to the first port of at least one of the first subset of cells by a conduit, and wherein the second pump outlet is operatively connected to the first port of at least one of the second subset of cells by a conduit.

* * * * *